United States Patent [19]

Bucci

[11] 3,983,384

[45] Sept. 28, 1976

[54] COMBINATION LANTERN

[75] Inventor: Archangelo Joseph Bucci, Bayonne, N.J.

[73] Assignee: Lawrence Peska Associates, Inc., New York, N.Y. ; a part interest

[22] Filed: May 13, 1975

[21] Appl. No.: 577,067

[52] U.S. Cl. ..... 240/37; 240/11; 240/72

[51] Int. Cl.[2] ..... F21V 19/04

[58] Field of Search ..... 240/37, 11, 37.1, 72

[56] References Cited

UNITED STATES PATENTS

| | | | |
|---|---|---|---|
| 689,427 | 12/1901 | Simon | 240/37 |
| 1,136,580 | 4/1915 | Bergener | 240/37 |
| 3,334,218 | 8/1967 | Nawrocki | 240/37 X |
| 3,340,648 | 9/1967 | Frantzen | 240/11 X |

FOREIGN PATENTS OR APPLICATIONS

| | | | |
|---|---|---|---|
| 330,469 | 6/1930 | United Kingdom | 240/37 |

*Primary Examiner*—Ulysses Weldon

[57] ABSTRACT

This disclosure pertains to a portable illuminating lantern providing light selectively by an incandescent lamp or the burning of a combustible fuel.

6 Claims, 2 Drawing Figures

COMBINATION LANTERN

BACKGROUND OF THE INVENTION

1. The Field of the Invention

This invention relates to a portable illumination device requiring some form of stored energy to energize the light source.

2. Description of the Prior Art

Single source of power lamps abound. The lamps which are available, when malfunctioning or running out of fuel or energy, do not have reserve alternate means to provide light.

SUMMARY OF THE INVENTION

A portable lamp utilizing an incandescent bulb and a volatile fuel, each independently capable of providing illumination.

A primary object of the instant invention is to provide a light source providing two forms of lighting systems.

Another object is a light source that can be operated in close quarters when it is required not to consume oxygen or to emanate smoke.

Still another object is a dual system light that can be controlled in each lighting mode by the simple operation of a knob.

Another object is a light source which can provide light just prior to igniting the fuel, thereby facilitating its use in the dark.

Yet another object is a light source with multiple modes of operation thus permitting successful operation if any single mode fails to provide a light for any reason.

These objects, as well as other objects, of the invention will become readily apparent after reading the following description of the accompanying drawings.

DESCRIPTION OF THE PREFERRED EMBODIMENTS

The structure and method of fabrication of the present invention is applicable to a combination lantern utilizing a liquid or gaseous fuel in a combustible lighting mode and electrical energy derived from a battery supplying current to an incandescent bulb in another mode. A single selector switch completes an electrical circuit energizing the bulb and alternatively provides a fluid connection between the combustible fuel stored in the fuel compartment and the wick in variable amounts to regulate the light intensity by controlling the rate of fuel consumption.

Figure 1:
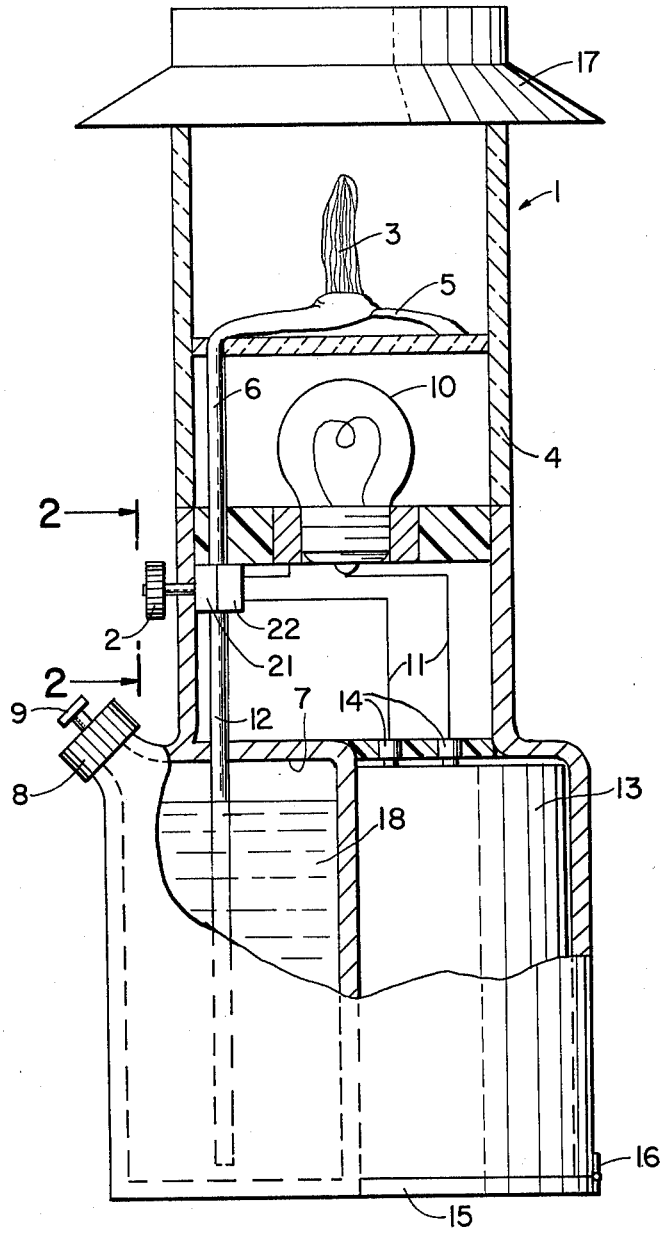
FIG. 1 is a fragmented elevation view of the combination lantern.

Now referring to the Figures and more particularly to the embodiment illustrated in FIG. 1 showing the combination lantern 1, controlled by a selector knob 2, which is used in one lighting mode to allow the fuel 18 to reach the fuel compartment 7, from the lower fuel duct 12, communicated through the valve 21 connected to the knob 2. When valve 21 is opened fuel communicates through the upper fuel duct 6 to a wick 3 fastened to a wick holder 5 beneath it. A fuel compartment cap 8 is adapted to close off an opening communicating through to compartment 7 and is complete with a pressurizing pump 9 for those types of fuels that require pressure to communicate the fuel to the wick. If a combustible gas is to be employed, the fuel pressurizing pump 9 need not be affixed or employed. The electrical mode of operaion of the combination lantern derives power from a battery 13 stored within an appropriate compartment at the base of the lantern having terminals 14 adapted by receiving wires 11 which interconnect electrically the incandescent lamp bulb 10 and switch 22 in a series electrical circuit. Operation of the knob 2, by its rotation, completes the electrical series circuit or opens it. Knob 2, when manually operated, alternatively completes the electrical series circuit or opens valve 21. A discreet rotational position of knob 2 both closes valve 21 and opens the contacts of switch 22, thereby terminating the illumination produced by the apparatus from either illuminating source. A shaft, not shown, interconnects switch 22 and valve 21 for manual rotation by knob 2. Battery 13 is inserted into the storage compartment by pivoting the access door 15 on the hinge 16 which is fastened to the exterior of the lantern. A glass chimney 4 surrounds the light emitting positions of the wick 3 and the lamp 10 and is surrounded by a combination chimney light and reflector at the uppermost end thereof.

Figure 2:
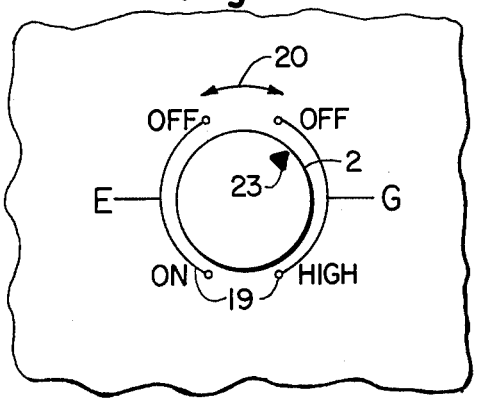
FIG. 2 is a fragmented view of a portion of the elevation view of FIG. 1 as viewed in the direction of the arrows 2—2.

FIG. 2 illustrates the scale 19 in the various positions that the knob 2 can be placed by rotation as indicated by the arrow 20. A pointer embossed ito the surface of the knob indicates the position and function of the electrical switch 22 and the fuel valve 21, not shown, mounted behind the fragmented portion of the exterior of the lantern. The scale indicates the alternative operation of the illuminating sources from either the E source, denoting electrical, or the G source, denoting gaseous. Valve 21, shown in FIG. 1, variably controls the volume of fuel communicating to wick 3 from lower fuel duct 12. When pointer 23 is rotated towards the end of the G scale, denoted by the word "high," more fuel communicates to wick 3 from lower fuel duct 12 than when pointer 23 is manually disposed closer to the "off" position on the G scale. The words "off" denote the ends of the E and G scale, adjacent one another, at which and inbetween which knob 2, when rotated, so as to have pointer 23 disposed thereat, completey darkens both modes of illumination of the instant apparatus.

One of the advantages is a light source capable of providing light by the use of two lighting systems.

Another advantage is that the combination light source can be operated in its electrical mode on those occasions when no oxygen is to be consumed or smoke generated.

Still another advantage is a lantern that can be controlled in each of its lighting modes by the simple operation of a single control knob.

Yet another advantage is a light capable of providing electrical illumination immediately preceding a point in time in which the combustible fuel is to be ignited, thus providing convenience to the user in darkened areas.

Another advantage is a multi-mode light source having each mode independent of the other and by providing light when the alternate mode fails to operate.

Thus, there is disclosed in the above description and in the drawings embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. A portable light source comprising a battery, a selector switch, an incandescent lamp, a combustible fuel, a valve, a knob, a series electrical circuit including said selector switch and said incandescent lamp and said battery, piping fluidly connecting said combustible fuel to said valve and to a point of combustion, said knob for manual operation of said valve and said selector switch, said knob capable of being manually disposed closing the terminals of said selector switch and closing said valve, said knob capable of being manually disposed opening said terminals of said selector switch and opening said valve, said knob capable of being manually disposed opening said terminals of said selector switch and closing said valve.

2. The portable light source as claimed in claim 1 wherein said combustible fuel is a liquid.

3. The portale light source as claimed in claim 1 wherein said combustible fuel is gas compressed to a pressure higher than atmospheric pressure.

4. The portable light source as claimed in claim 1 wherein said incandescent lamp is disposed intermediate the location of said point of combustion and the location of said battery.

5. The portable light source as claimed in claim 1 wherein said valve variably controls the volume of said combustible fuel flowing from a fuel compartment to said point of combustion.

6. The portable light source as claimed in claim 1 further comprising a transparent material substantially surrounding said point of combustion and said incandescent lamp.

* * * * *